US005659325A

United States Patent [19]

Belcher et al.

[11] Patent Number: 5,659,325

[45] Date of Patent: Aug. 19, 1997

[54] LOW IMPEDANCE LOOP ANTENNA AND DRIVE CIRCUITRY

[75] Inventors: Donald K. Belcher; Gregory H. Marquardt, both of W. Melbourne, Fla.

[73] Assignee: Harris Corporation, Melbourne, Fla.

[21] Appl. No.: 352,834

[22] Filed: Dec. 2, 1994

[51] Int. Cl.[6] ..... H01Q 1/12

[52] U.S. Cl. ..... 343/718; 343/744; 455/193.1

[58] Field of Search ..... 343/718, 741, 343/744, 866; 455/193.1, 354; H01Q 1/12, 7/00, 7/08

[56] References Cited

U.S. PATENT DOCUMENTS

| | | | |
|---|---|---|---|
| 2,501,430 | 3/1950 | Alford | 343/741 |
| 3,736,591 | 5/1973 | Rennels et al. | 343/718 |
| 4,817,196 | 3/1989 | MacNak et al. | 343/718 |
| 5,072,231 | 12/1991 | Koyama | 343/718 |
| 5,134,418 | 7/1992 | Gomez et al. | 343/718 |
| 5,134,724 | 7/1992 | Gehring et al. | 343/718 |

FOREIGN PATENT DOCUMENTS

| | | | |
|---|---|---|---|
| 0169401 | 12/1981 | Japan | 343/718 |
| 3296305 | 12/1991 | Japan | H01Q 7/00 |

*Primary Examiner*—Donald T. Hajec
*Assistant Examiner*—Tan Ho
*Attorney, Agent, or Firm*—Rogers & Killeen

[57] ABSTRACT

An antenna and method of minimizing capacitive effects of a capacitive body on a loop antenna. The antenna includes a loop antenna, a drive circuit for driving a current through the loop antenna, matching means for matching the impedance of the drive circuit and the loop antenna and a housing for carrying the loop antenna, drive circuit and matching means. The loop antenna is formed from a band of conductive material such that the flat sides of the band are normal to the plane of the loop. The loop antenna is carried by the housing when the housing is carried by a human body with its flat sides normal to the human body and its edges parallel to the human body. The orientation of the loop antenna relative to the human body minimizes the capacitive effect of the human body on the loop antenna and thus decreases the impedance to the flow of current through the loop antenna.

16 Claims, 1 Drawing Sheet

LOW IMPEDANCE LOOP ANTENNA AND DRIVE CIRCUITRY

BACKGROUND OF THE INVENTION

The present invention relates to loop antennas which operate in close proximity to a human body. More specifically, the invention relates to loop antennas where the capacitive effect of the human body on the loop antenna is minimized and thus the impedance to current flow through the loop antenna is minimized.

Loop antennas are commonly used in telecommunications devices that are worn on or near the human body, such as pagers. Typically the loop antennas are configured to be "electrically small" such that the diameter of the loop antenna is much less than its operating wavelength. The loop antennas are advantageous in that they have a relatively low impedance which makes them somewhat immune to the capacitive effects of the human body. Nevertheless, much effort has been directed towards further minimizing these capacitive effects as illustrated in U.S. Pat. No. 5,072,231, and U.S. Pat. No. 4,327,444.

Electrically small loop antennas have an impedance which can be characterized by the equation:

$$Z=Rr+Rl+jWLl,$$

where Rr is the radiation resistance, Rl is the loss resistance and Ll is the loop inductance. Since the transmit power is proportional to the square of the antenna current times Rr, it is desirable to maximize Rr and minimize Rl and Ll in order to maximize the transmit power of the antenna. The capacitance of a human body affects the antenna performance by affecting the value of Rl and Ll. Thus, by minimizing the capacitive effect, Rl and Ll are minimized and the performance of the loop antenna is enhanced.

Furthermore, the low impedance associated with electrically small loop antennas makes it difficult to efficiently drive a current through the antenna, especially if the current is driven by a transistor having a low operating voltage. The problem is that the output impedance of the transistor is relatively high compared to the input impedance of the loop antenna thereby creating an impedance mismatch which makes it difficult to efficiently drive current. By decreasing the impedance mismatch between the transistor and the loop antenna, the antenna current is increased and the performance of the antenna is enhanced.

It is accordingly an object of the present invention to provide a novel antenna and method which minimizes the capacitive effect of a capacitive body.

A further object of the present invention is to provide a novel antenna where the current through the antenna is maximized by matching the antenna impedance with that of a transistor.

It is yet a further object of the present invention to provide a novel antenna and method where a loop antenna is oriented relative to a human body to maximize the antenna current.

It is still a further object of the present invention to provide a method of optimally operating a low impedance loop antenna.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
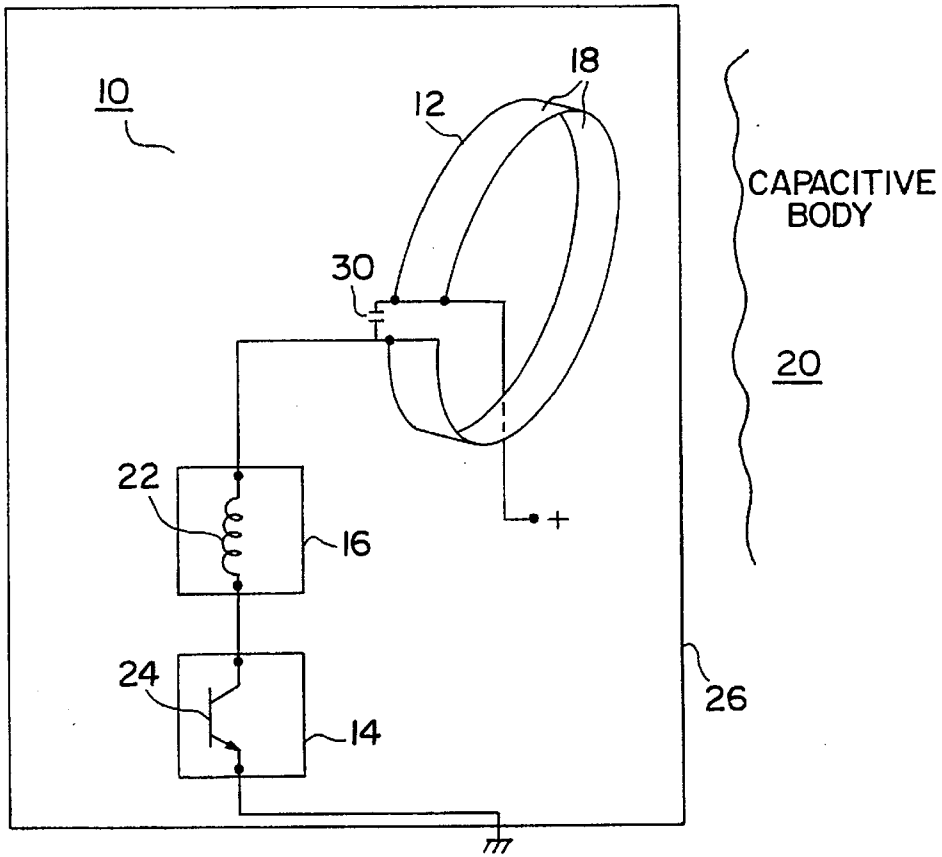
FIG. 1 is a functional block diagram of one embodiment of the present invention.

A preferred embodiment of the antenna of the present invention is shown in FIG. 1. Referring to FIG. 1, an antenna 10 for operating in close proximity to a capacitive body 20, such as a human body, is shown. The antenna 10 includes a loop antenna 12 for transmitting and/or receiving a signal, a drive circuit 14 for driving a current through the loop antenna 12, matching means 16 for matching the impedance of the drive circuit 14 with the impedance of the loop antenna 12 and a housing 26 for carrying the loop antenna 12, drive circuit 14 and matching means 16.

The loop antenna 12 may be formed from a band of conductive material so that the flat sides of the band 18 are normal to the plane of the loop. The loop antenna 12 may be electrically small having a diameter which is much less than the operating wavelength of the loop antenna 12. In the preferred embodiment, the loop antenna 12 diameter may be about a few inches and the operating frequency may be about 49 Mhz, although these parameters may vary significantly. Whereas metal material is preferred, the loop antenna 12 may be made from any known conductive material suitable to act as an antenna.

The matching means 16 in FIG. 1 may be any known means for matching the impedance of two devices. The matching means 16 may be series coupled to the drive circuit 14 and the loop antenna 12 and serves to adjust the impedance of the drive circuit 14 to match the impedance of the loop antenna 12. In a preferred embodiment, the matching means 16 may include an inductor 22 in series with the drive circuit 14 which adjusts the impedance thereof to match or closely match that of the loop antenna 12 thereby decreasing the impedance to current flow through the loop antenna 12.

The drive circuit 14 may be series coupled to the loop antenna 12 and may be any known means for driving a current through the loop antenna 12. The drive circuit 14 may also be series coupled to the matching means 16 whereby the output impedance of the drive circuit 14 is adjusted to match the input impedance of the loop antenna 12. Alternatively, the drive circuit 14 may include a transistor 24 series coupled to the matching means 16 to thereby adjust the output impedance of the transistor 24 to match the input impedance of the loop antenna 12. In a preferred embodiment, the drive circuit 14 includes a low voltage transistor 24 with its current path series coupled to the matching means 16, or preferably to the inductor 22 of the matching means 16, whereby the output impedance of the transistor 24 is adjusted to match that of the loop antenna 12. In this way the current driven by the drive circuit 14 flows through the loop antenna 12 more efficiently.

The preferred embodiment may also include a capacitor 30 interconnecting the ends of the band 18. The capacitor 30 may be sized to enhance the resonance of the circuit at the desired transmission frequency.

Figure 2:
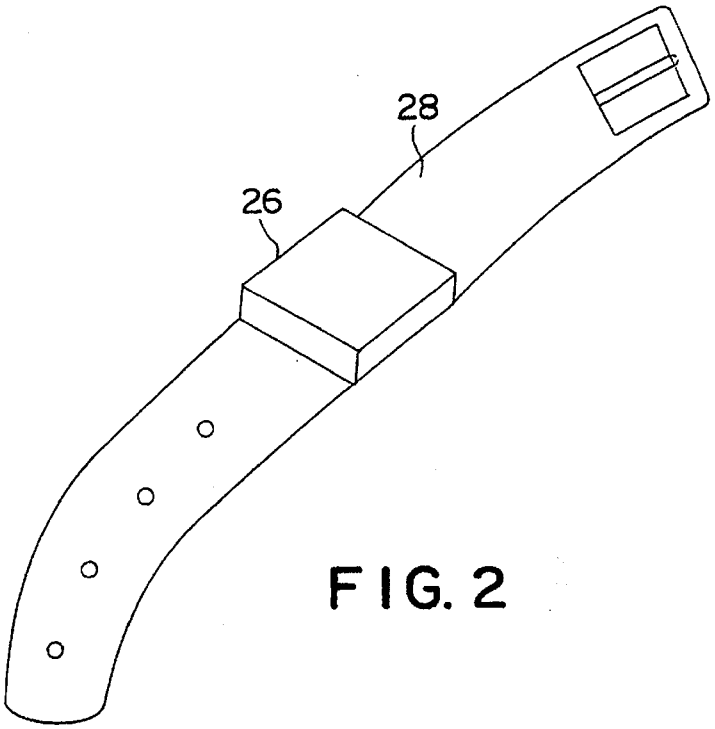
FIG. 2 is an illustration of one embodiment of the present invention.

The antenna includes a housing 26 designed to carry the loop antenna 12, drive circuit 14 and matching means 16. Preferably, the housing 26 is designed to be small in size and includes any known means for facilitating being carried by a human or other capacitive body 20. Such means, for example, may be a clip for attaching the housing 26 to clothing of a human or a strap for directly attaching the housing to the body of human. In the preferred embodiment as shown in FIG. 2, a wrist band 28 similar to a watch band may be used for attaching the housing 26 to the human wrist. Regardless of the actual means used, it will be understood that the loop antenna 12, drive circuit 14 and matching means 16 are designed to be carried by the housing 26 which is designed to be carried by a human or capacitive body.

The loop antenna 12 is carried by the housing 26 while the housing 26 is being carried by a human body so that the loop antenna 12 does not encompass any portion of the human body. In the preferred embodiment, while the housing 26 is being carried by the human body, the flat sides 18 of the loop antenna 12 are substantially normal to the human body and the edges of the loop antenna 12 are substantially parallel to the human body. In this way the orientation of the loop antenna 12 while the housing 26 is being carried by the human body tends to minimize the capacitive effect of the human body on the loop antenna 12 while the antenna 10 is operating and thus to reduce the impedance to the current flow through the loop antenna 12. Although in the preferred embodiment the loop antenna 12 operates as a transmitter, it will be understood that similar results are achieved when the loop antenna 12 operates as a receiver.

Operatively, the present invention is a method of reducing the capacitive effect of the human body on a loop antenna 12 and thus of reducing the impedance to current through the loop antenna 12 by carrying the loop antenna 12 by the housing 26 while the housing 26 is being carried by the human body so that the flat sides 18 of the loop antenna 12 are normal to the human body and the edges of the loop antenna 12 are parallel to the human body. Furthermore, it will be understood that the present invention can be adapted to reduce the capacitive effect of any capacitive body on a loop antenna 12 by orienting the loop antenna 12 so that the flat sides 18 thereof are normal to the capacitive body and the edges are parallel to the capacitive body.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. An antenna for a personal communication device comprising:

a housing;

a wrist band adapted to attach said housing to a human wrist;

an electrically small loop antenna formed of a flat band of electrically conductive material with the flat sides of said band normal to the plane of said loop antenna, said loop antenna being carried by said housing when said housing is attached to a human wrist with the flat sides of said loop antenna normal to the wearer's wrist and the edges of said loop antenna parallel to the wearer's wrist so that no part of the wrist is encompassed by the loop, whereby the orientation of said loop antenna relative to the human wrist when worn thereon tends to minimizes the capacitive effect of the human wrist on the loop antenna and thus to reduce the impedance to current flow through said loop antenna.

2. The antenna of claim 1 further comprising:

a drive circuit having a low voltage transistor carried by said housing and operatively connected to said loop antenna for driving a current therethrough; and matching means for matching the output impedance of said drive circuit with the input impedance of said loop antenna to thereby provide a wrist carried transmitter.

3. The antenna of claim 2 wherein said matching means comprises an inductor in series with the current path through said transistor to adjust the output impedance of said drive circuit to match the input impedance of said loop antenna.

4. The antenna of claim 1 further comprising a capacitor connecting ends of said flat band in said loop antenna, an inductor connected to said capacitor, and a low voltage transistor carried by said housing and having its collector connected in series with said inductor and said capacitor, wherein said capacitor, said inductor and said collector are for matching said transistor output impedance to said loop antenna input impedance.

5. The method of reducing the impedance of an antenna for a personal communication device adapted to be worn on a human wrist comprising the steps of:

providing a housing having a wrist band adapted to attach the housing to a human wrist;

providing a loop antenna formed of a flat band of electrically conductive material with the flat sides of the band normal to the plane of the loop antenna, carrying the loop antenna by the housing when said housing is attached to a human wrist with the flat sides of said loop antenna normal to the wearer's wrist and the edges of the loop antenna parallel to the wearer's wrist so that no part of the wrist is encompassed by the loop, whereby the orientation of the loop antenna relative to the human wrist when worn thereon tends to minimize the capacitive effect of the human wrist on the loop antenna and thus to reduce the impedance to current flow through said loop antenna.

6. An antenna comprising:

a flat wire loop antenna with the wide dimension of the antenna wire normal to the plane of the loop of the antenna; and a housing for carrying said loop antenna, said housing having means to facilitate the carrying thereof by a capacitive body, and said antenna being oriented within said housing when said housing is being carried by a capacitive body such that said loop antenna is in close proximity to the capacitive body without encompassing any portion of the capacitive body, and with edges of said antenna substantially parallel to the capacitive body and the flat sides of said antenna substantially normal to the capacitive body for reducing an effect of the capacitive body on an effective impedance of said antenna to current flow through said antenna.

7. The antenna of claim 6 further comprising:

a drive circuit operatively connected to said antenna for driving a current therethrough; and matching means for matching the output impedance of said drive circuit with the input impedance of said loop antenna.

8. The antenna of claim 7 wherein said drive circuit comprises a low voltage transistor; and wherein said matching means comprises an inductor in series with said transistor.

9. The antenna of claim 8 wherein said loop antenna is electrically small and is comprised of metal.

10. The antenna of claim 6 further comprising a drive circuit having a low voltage transistor carried by said housing and operatively connected to said loop antenna for driving a current therethrough, an inductor for matching the output impedance of said drive circuit with the input impedance of said loop antenna and a capacitor connecting ends of a band forming said loop antenna, and wherein said capacitor, said inductor, and a collector of said transistor are connected in series.

11. A method of reducing the impedance of a loop antenna in close proximity to a capacitive body comprising the steps of:

a) providing a loop antenna formed of a band of electrically conductive material with the flat portion of the band substantially normal to the plane of the loop; and b) orienting the loop antenna so that the loop antenna does not encompass any portion of the capacitive body, wherein the loop antenna is oriented with the edges thereof substantially parallel to the capacitive body.

12. The method of claim 11 further comprising the steps of:

c) providing a low voltage transistor drive circuit;

d) providing an inductor; and e) driving a current from the drive circuit through the inductor and the loop antenna, the impedance of the inductor matching the output impedance of the drive circuit with the impedance of the loop antenna.

13. The method of claim 12 further comprising the step of providing a capacitor which connects ends of the band of the loop antenna, and connecting in series the capacitor, the inductor and a collector of a transistor in the drive circuit.

14. An antenna comprising:

a loop antenna adapted to operate in close proximity to a capacitive body;

a drive circuit having a transistor for driving a current through said loop antenna;

inductor means in series with said loop antenna and said drive circuit for matching the output impedance of the said drive circuit with the input impedance of said loop antenna to thereby minimize the impedance to the flow of current through said loop antenna from said drive circuit, and a capacitor connecting ends of a band forming said loop antenna, and wherein said capacitor, said inductor means, and a collector of said transistor are connected in series.

15. The antenna of claim 14 further comprising a housing for said antenna, wherein said antenna comprises a flat band of electrically conductive material, and wherein said antenna is oriented within said housing when said housing is being carried by a capacitive body with the edges of said antenna substantially parallel to the capacitive body and the flat sides of said antenna substantially normal to the capacitive body, so that the effect of the capacitive body on the effective impedance of said loop antenna to current flow through said loop antenna is reduced.

16. The antenna system of claim 14 wherein said drive circuit includes said transistor having a low operating voltage; and wherein said loop antenna is electrically small.

* * * * *